US009559408B2

(12) United States Patent
Kim

(10) Patent No.: US 9,559,408 B2
(45) Date of Patent: Jan. 31, 2017

(54) ANTENNA WHICH CAN BE USED AS DIVERSITY ANTENNA

(71) Applicant: ACE TECHNOLOGIES CORPORATION, Incheon-si (KR)

(72) Inventor: Byoung-Nam Kim, Gyeonggi-do (KR)

(73) Assignee: ACE TECHNOLOGIES CORPORATION, Incheon-si (KR)

( * ) Notice: Subject to any disclaimer, the term of this patent is extended or adjusted under 35 U.S.C. 154(b) by 465 days.

(21) Appl. No.: 14/088,120

(22) Filed: Nov. 22, 2013

(65) Prior Publication Data

US 2014/0145889 A1 May 29, 2014

(30) Foreign Application Priority Data

Nov. 23, 2012 (KR) ..... 10-2012-133985

(51) Int. Cl.

| | |
|---|---|
| ***H01Q 1/00*** | (2006.01) |
| ***H01Q 1/24*** | (2006.01) |
| ***H01Q 7/00*** | (2006.01) |
| ***H01Q 9/04*** | (2006.01) |
| ***H01Q 9/32*** | (2006.01) |
| ***H01Q 9/42*** | (2006.01) |
| ***H01Q 21/28*** | (2006.01) |

(52) U.S. Cl.

CPC ..... *H01Q 1/244* (2013.01); *H01Q 7/00* (2013.01); *H01Q 9/0421* (2013.01); *H01Q 9/32* (2013.01); *H01Q 9/42* (2013.01); *H01Q 21/28* (2013.01)

(58) Field of Classification Search

CPC ..... H01Q 1/244
USPC ..... 343/724
See application file for complete search history.

*Primary Examiner* — Graham Smith
(74) *Attorney, Agent, or Firm* — TechLaw LLP

(57) ABSTRACT

An antenna device capable of using an existing external antenna as a diversity antenna is disclosed. The disclosed antenna device includes: a radiator configured to be extensible to the outside of a terminal; a feeding switch configured to perform a switching operation for connecting one of a plurality of feeding units to the radiator; at least one conductive line of which a first end coming into contact with a part of the radiator when the radiator is inserted into the inside of the terminal; and at least one ground switch coupled to the at least one conductive line and configured to switch a connection between a second end of the conductive line and the ground. In accordance with the disclosed antenna device, it is possible to use an existing external antenna as a diversity antenna without installing an additional antenna.

4 Claims, 5 Drawing Sheets

ANTENNA WHICH CAN BE USED AS DIVERSITY ANTENNA

CROSS-REFERENCE TO RELATED APPLICATIONS

This application claims priority to Korean Patent Application No. 2012-133985 filed on Nov. 23, 2012, the entire contents of which are incorporated herein by reference.

FIELD OF THE INVENTION

The exemplary embodiment relate to an antenna; and, more particularly, to an antenna device capable of being used as a diversity antenna.

BACKGROUND OF THE INVENTION

A DMB antenna which belongs to an external antenna serves to receive signals of a DMB frequency band. The external antenna is mainly used as the DMB antenna to receive DMB signals of a relatively low frequency band. The DMB antenna occupies a very large space of a terminal since it is the external antenna, but is not applicable to various purposes except the purpose of receiving DMB signals. Accordingly, usage of the DMB antenna compared with the occupied space is very low.

Meanwhile, a diversity antenna has recently been used for secure signal receipt. The diversity antenna includes a main antenna and an additional antenna for receiving signals of the same frequency band as that of the main antenna. The diversity antenna is advantageous in that the additional antenna can complement the main antenna when the main antenna does not receive signals well.

Even though facilitating more secure signal receipt, the diversity antenna has many restrictions to be applied to various terminals allowing for the recent trend for compact size since an additional antenna is required.

The above information disclosed in this Background section is only for enhancement of understanding of the background of the invention and therefore it may contain information that does not form the prior art that is already known in this country to a person of ordinary skill in the art.

SUMMARY OF THE INVENTION

In view of the above, the present exemplary embodiment supposes an antenna device capable of using an existing external antenna as a diversity antenna without installing an additional antenna.

In accordance with an aspect of the present exemplary embodiment, there is a provided an antenna device including: a radiator configured to be extensible to the outside of a terminal; a feeding switch configured to perform a switching operation for connecting one of a plurality of feeding units to the radiator; at least one conductive line of which a first end coming into contact with a part of the radiator when the radiator is inserted into the inside of the terminal; and at least one ground switch coupled to the at least one conductive line and configured to switch a connection between a second end of the conductive line and the ground.

The feeding units may include a main feeding unit, a first frequency feeding unit, and a second frequency feeding unit.

The feeding switch may perform a first switching operation to enable the feeding line to connect the main feeding unit to a back end portion of the radiator when the antenna device is operated in a first receiving mode and perform a second switching operation to enable the feeding line to connect one of the first and second frequency feeding units to a front end portion of the radiator when the antenna device is operated in a second receiving mode.

The at least one conductive line may be coupled to a portion between the front end portion and the back end portion of the radiator, and the ground switch may switch a connection of the at least one conductive line with the ground to operate the radiator as a PIFA (Planer Inverted-F Antenna) antenna.

The at least one conductive line may be coupled to the back end portion of the radiator, and the ground switch may switch a connection of the at least one conductive line with the ground to operate the radiator as a loop antenna.

The feeding switch may connect the radiator to the main feeding unit when the radiator is externally extended and connect the radiator to one of the first frequency feeding unit and the second frequency feeding unit when the radiator is internally inserted.

A first one of the at least one conductive line may be coupled to a portion between the front end portion and the back end portion of the radiator when the radiator is connected to the first feeding unit, and the ground switch may switch a connection of the first conductive line with the ground to operate the radiator as a PIFA antenna.

A second one of the at least one conductive line may be coupled to the back end portion of the radiator when the radiator is connected to the second feeding unit, and the ground switch may switch a connection of the second conductive line with the ground to operate the radiator as a loop antenna.

In accordance with the present exemplary embodiment, it is possible to provide an antenna device capable of using an existing external antenna as a diversity antenna without installing an additional antenna.

BRIEF DESCRIPTION OF THE DRAWINGS

The objects and features of the present invention will become apparent from the following description of embodiments, given in conjunction with the accompanying drawings, in which.

DETAILED DESCRIPTION OF THE EMBODIMENTS

Figure 1:
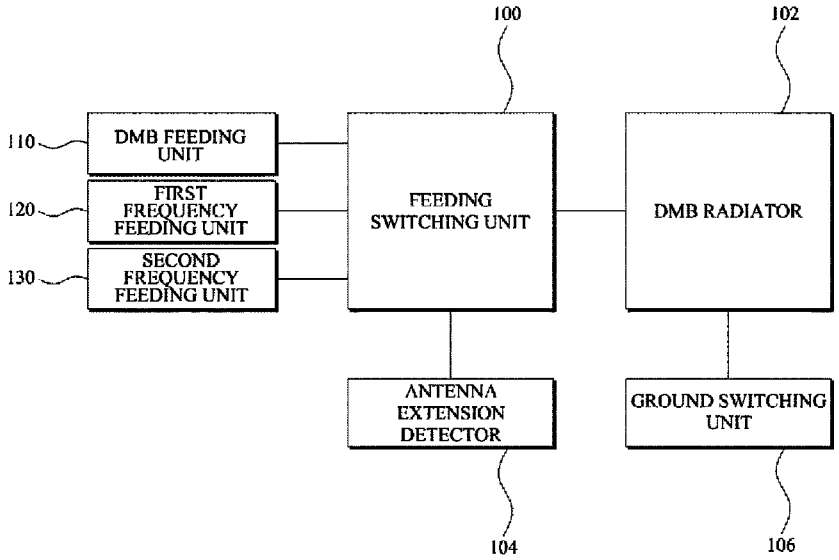
FIG. 1 shows a conceptual configuration of a DMB antenna device capable of being used as a diversity antenna in accordance with an exemplary embodiment of the present invention.

Since there can be a variety of permutations and embodiments of the present invention, certain embodiments will be illustrated and described with reference to the accompanying drawings. This, however, is by no means to restrict the present invention to certain embodiments, and shall be construed as including all permutations, equivalents and substitutes covered by the spirit and scope of the present invention. Throughout the drawings, similar elements are given similar reference numerals. An exemplary embodiment of present invention will now be described with reference to the accompanying drawings which form a part thereof.

In the present exemplary embodiment, it is assumed that an antenna to which the present invention is applied is a DMB antenna as a kind of external antenna for the convenience of description. However, it shall be obvious to a person of an ordinary skill in the art that the present exemplary embodiment is applicable to other kinds of external antennas as well as the DMB antenna.

FIG. 1 shows a conceptual configuration of a DMB antenna device capable of being used as a diversity antenna in accordance with an exemplary embodiment of the present invention.

Referring to FIG. 1, the antenna device of the present exemplary embodiment may include a feeding switching unit 100, a DMB radiator 102, an antenna extension detector 104, and a ground switching unit 106.

The DMB radiator 102 serves as a radiator for receiving DMB signals and having a whip-antenna shape which is extensible to the outside of a terminal. The whip antenna serves as an antenna which is mounted inside the terminal in a DMB non-receiving mode and is mounted to extend toward the outside of the terminal in a DMB receiving mode. The whip antenna has a multi-stage structure, and thus a user can adjust the length of the antenna which is extensible. The DMB radiator 102 may have various forms of radiator shapes including the whip-antenna shape.

The feeding switching unit 100 serves to switch a connection between the DMB radiator 102 and a specific one of a plurality of feeding units. In FIG. 1, three feeding units, i.e., a DMB feeding unit 110, a first frequency feeding unit 120, and a second frequency feeding unit 130 are shown, and the feeding switching unit 100 serves to connect one of these feeding units to the DMB radiator 102.

The DMB feeding unit 110 serves as a module for feeding DMB signals and processing received DMB signals. The first frequency feeding unit 120 and the second frequency feeding unit 130 serve as modules for feeding signals of different frequency bands from those of the DMB signals and processing received signals. For example, the first frequency feeding unit 120 may be a module for feeding and receiving signals of a frequency band having the central frequency of 1.8 GHz among LTE frequency bands, and the second frequency feeding unit 130 may be a module for feeding and receiving signals of a frequency band having the central frequency band of 800 MHz among the LTE frequency bands.

The antenna device of the present exemplary embodiment is basically operated as the DMB radiator for receiving DMB signals and, when it is not in the DMB receiving mode, is operated as a diversity antenna for receiving signals of other frequency bands (e.g., LTE frequency band). The feeding switching unit 100 serves to switch connections with the feeding units such that the antenna device of the present exemplary embodiment can be operated as the diversity antenna for receiving the signals of other frequency bands. For the diversity antenna, an independent diversity antenna is usually used for receiving the same signals as the signals being received by a main antenna. The general diversity antenna is independent of the main antenna and is typically operated in order to securely receive signals. However, in the present exemplary embodiment, the DMB antenna can be operated as the diversity antenna in the DMB non-receiving mode.

The feeding switching unit 100 may perform a switching operation through control signals of a controller (not shown) included in the terminal and/or by using detection signals of the antenna extension detector 104 and information related to used frequencies of the terminal.

The antenna extension detector 104 serves to detect whether the DMB radiator 102 is externally extended or internally inserted. When the feeding switching unit 100 and the ground switching unit 106 perform switching operations by using built-in determining modules (not shown), extension detection information of the antenna extension detector 104 is transmitted to the feeding switching unit 100 and the ground switching unit 106. When the feeding switching unit 100 and the ground switching unit 106 perform the switching operations by receiving control signals from a controller (not shown), the antenna extension detector 104 transmits an extension detection signal to the controller.

The ground switching unit 106 performs a switching operation so as to electrically connect the DMB radiator 102 to a conductive line connected to the ground when the DMB radiator 102 is operated as a diversity antenna for a first frequency band or a second frequency band.

The DMB radiator 102 is an antenna for receiving DMB signals, and thus has an adequate electrical length for receiving signals of DMB frequency bands. Further, the DMB radiator 102 belongs to an external antenna such as a whip antenna, having a monopole-antenna shape. Accordingly, the DMB radiator 102 is not electrically connected to the ground.

The ground switching unit 106 switches a connection relationship between the DMB radiator 102 and the conductive line connected to the ground to adjust an operation shape and an electrical length of the antenna in such a way so as to be adequate for the signals of the first or second frequency band in a state where the DMB radiator 102 is inserted into the inside of the terminal.

For example, the ground switching unit 106 enables the DMB radiator 102 to be operated as a planar inversed-F antenna (PIFA) radiator by coupling the conductive line connected to the ground to a middle part of the DMB radiator 102 to allow the DMB radiator 102 to be operated as a diversity antenna for the first frequency band.

Further, the ground switching unit 106 enables the DMB radiator 102 to be operated as a loop radiator by coupling the conductive line connected to the ground to an end part of the DMB radiator 102 to allow the DMB radiator 102 to be operated as a diversity antenna for the second frequency band.

Figure 2:
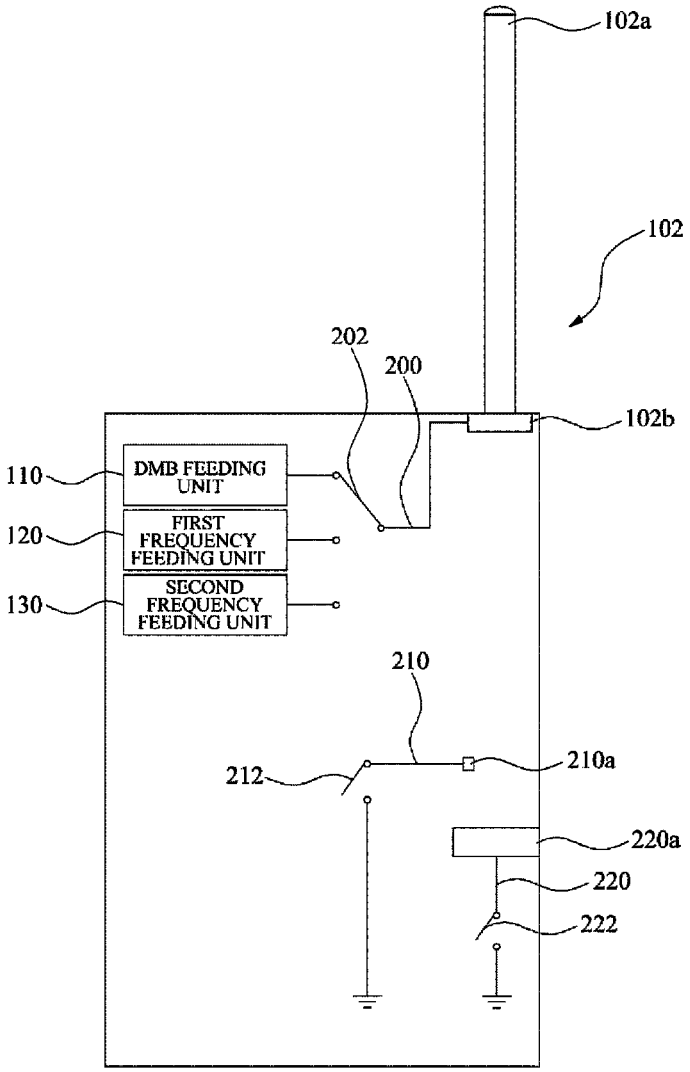
FIG. 2 shows a detailed structure of an antenna device in accordance with the present exemplary embodiment when the antenna device is operated in a DMB receiving mode.

FIG. 2 shows a detailed structure of an antenna device in accordance with the present exemplary embodiment when the antenna device is operated in a DMB receiving mode.

Referring to FIG. 2, the antenna device of the present exemplary embodiment of the present invention includes the DMB radiator 102, a feeding line 200, a feeding switch 202, a first conductive line 210, a first ground switch 212, a second conductive line 220, and a second ground switch 222.

It shall be obvious to a person of an ordinary skill in the art that the structure shown in FIG. 2 is a conceptual structure, and thus a substantial mechanical structure may be embodied differently from the conceptual structure shown in FIG. 2.

As shown in FIG. 2, the DMB radiator 102 is externally extended when the antenna device is operated in the DMB receiving mode. The DMB radiator 102 has a front end portion 102*a* and a back end portion 102*b*, and the back end portion 102*b* of the DMB radiator 102 is electrically connected to the feeding line 200 when the DMB radiator 102 is externally extended.

The feeding switch 202 performs a switching operation to connect the feeding line 200 to one of the DMB feeding unit 110, the first frequency feeding unit 120, and the second frequency feeding unit 120; and the feeding switch 202 performs a switching operation to electrically connect the feeding line 200 to the DMB feeding unit 110 when the antenna device is operated in the DMB receiving mode.

The back end portion 102*b* of the DMB radiator 102 is electrically connected to the DMB feeding unit 110, and thus signals received through the DMB radiator 102 are transferred to the DMB feeding unit 110 to be processed.

Since the DMB radiator 102 is externally extended, the DMB radiator 102 is not connected to the first conductive line 210 and the second conductive line 220, the operation of the antenna is not affected by the first conductive line and the second conductive line 220.

Figure 3:
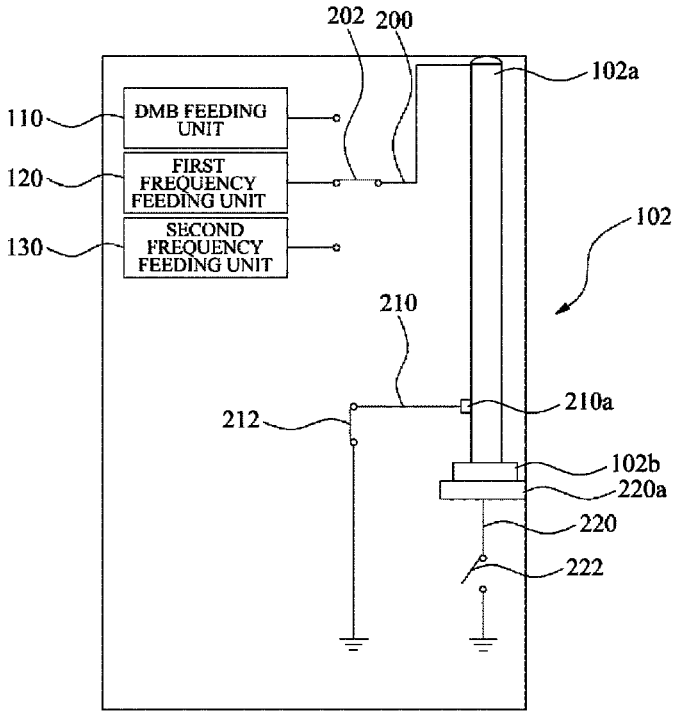
FIG. 3 shows the structure of the antenna device of the present exemplary embodiment when the antenna device is operated as a diversity antenna for a first frequency band.

FIG. 3 shows the structure of the antenna device of the present exemplary embodiment when the antenna device is operated as a diversity antenna for a first frequency band. Referring to FIG. 3, when the antenna device is operated in a diversity mode for the first frequency band, the DMB radiator 102 is inserted into the inside of the terminal.

Once the DMB radiator 102 is inserted into the inside of the terminal, the feeding line 200 is electrically coupled to the front end portion 102*a* of the DMB radiator 102. When the antenna device is operated in the diversity mode for the first frequency band, the feeding switch 202 performs a switching operation to electrically connect the feeding line 200 to the first frequency feeding unit 120. As the switching operation is performed, first frequency signals are fed to the front end portion 102*a* of the DMB radiator 102.

While the DMB radiator 102 is inserted into the inside of the terminal, the DMB radiator 102 is electrically coupled to the first conductive line 210 and the second conductive line 220. The first conductive line 210 and the second conductive line 220 may be formed in various patterns such as a conductive pattern and a cable and have contact portions 210*a* and 220*a* for coming into contact with the DMB radiator 102.

The contact portion 210*a* of the first conductive line 210 is brought into electrical contact with a middle part of the DMB radiator 102, and the contact portion 220*b* of the second conductive line 220 is brought into electrical contact with the back end portion 102*b* of the DMB radiator 102.

Opposite end portions of the first conductive line 210 and the second conductive line 220 to the contact portions 210*a* and 220*a* thereof are electrically connected to the ground. The first ground switch 212 and the second ground switch 222 are respectively coupled to the first conductive line 210 and the second conductive line 220, and the first ground switch 212 and the second ground switch 222 respectively switch connections between the first conductive line 210 and the second conductive line 220 line and the ground.

When the antenna device is operated in the diversity mode for the first frequency band, the first ground switch 212 of the first conductive line 210 is turned on to electrically connect the first conductive line 210 to the ground. While the first ground switch 212 is turned on, the DMB radiator 102 is electrically connected to the first conductive line 210, thereby varying the electrical length of the antenna. Further, since the first conductive line 210 is electrically connected to the ground, when the first ground switch is turned on, the DMB radiator 102 is operated as a PIFA radiator instead of the previous monopole radiator. The PIFA radiator serves as an antenna having a structure in which a point of the radiator is connected to the ground and is operated as a PIFA antenna by coupling a first conductive line connected to the ground to a middle part of the DMB radiator 102.

When the antenna device is operated in the diversity mode for the first frequency band, the second ground switch of the second conductive line 220 is turned off.

Figure 4:
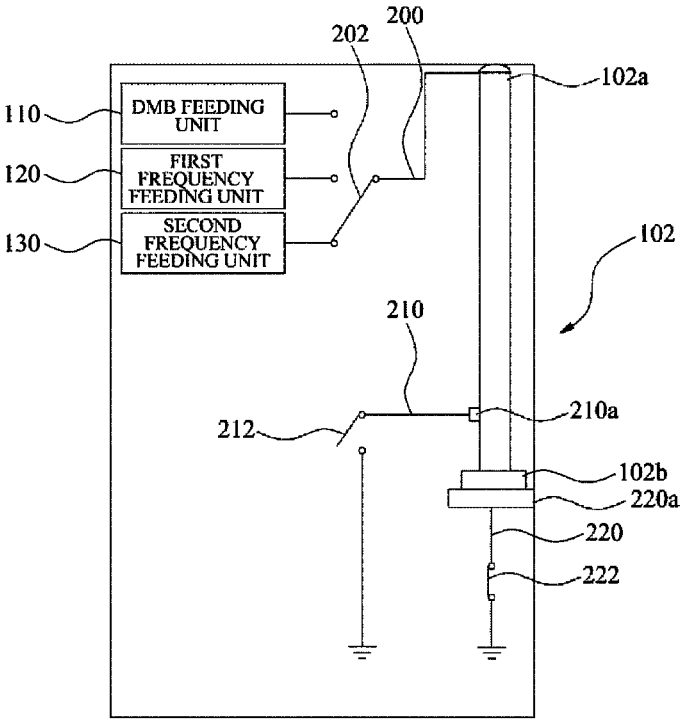
FIG. 4 shows the structure of the antenna device of the present exemplary embodiment when the antenna device is operated as a diversity antenna for a second frequency.

FIG. 4 shows the structure of the antenna device of the present exemplary embodiment when the antenna device is operated as a diversity antenna for a second frequency.

Referring to FIG. 4, when the antenna device is operated in a diversity mode for the second frequency band, the DMB radiator 102 is inserted into the inside of the terminal.

Once the DMB radiator 102 is inserted into the inside of the terminal, the feeding line 200 is electrically coupled to the front end portion 102*a* of the DMB radiator 102. When the antenna device is operated in the diversity mode for the second frequency band, the feeding switch 202 performs a switching operation to electrically connect the feeding line 200 to the second frequency feeding unit 130. As the switching operation is performed, second frequency signals are fed to the front end portion 102*a* of the DMB radiator 102.

While the DMB radiator 102 is inserted into the inside of the terminal, the DMB radiator 102 is electrically coupled to the contact portion 210*a* and 220*a* of the first conductive line 210 and the second conductive line 220 When the terminal is operated in the diversity mode for the second frequency band, the first ground switch 212 coupled to the first conductive line 210 is turned off. Accordingly, the operation of the DMB radiator 102 is not affected by the first conductive line 210.

Further, the second ground switch 222 coupled to the second conductive line 220 is turned off. When the second ground switch 222 by which the second conductive line is connected to the ground is turned on, the second back end portion 102*b* of the DMB radiator 102 is brought into contact with the second conductive line 220. As a result, signals are fed to the first end portion 102*a* of the DMB radiator 102 and the opposite end portion thereof is connected to the ground.

As such, an antenna having one end to which signals are fed and the other end connected to the ground serves as a loop antenna, and thus the antenna device of the present exemplary embodiment is operated as the loop antenna when it is operated in the diversity mode for the second frequency band. An operating frequency when the antenna device is operated in the diversity mode for the second frequency band may be adjusted by controlling the length of the second conductive line 220.

As described above, the first frequency band may be a frequency band having the central frequency of 1.8 GHz among the LTE frequency bands, and the second frequency band may be a frequency band having the central frequency of 800 MHz among the LTE frequency bands.

As a result, when operated in a mode in which no DMB signal is received and signals of the frequency band having the central frequency of 1.8 GHz among the LTE frequency bands are received, the antenna device of the present exemplary embodiment is operated as a diversity antenna for the frequency band of the 1.8 GHz by being operated as the PIFA antenna.

Further, when operated in the mode in which no DMB signal is received and signals of the frequency band having the central frequency of 800 MHz among the LTE frequency bands are received, the antenna device of the present exemplary embodiment is operated as a diversity antenna for the frequency band of the 800 MHz by being operated as the loop antenna.

Figure 5:
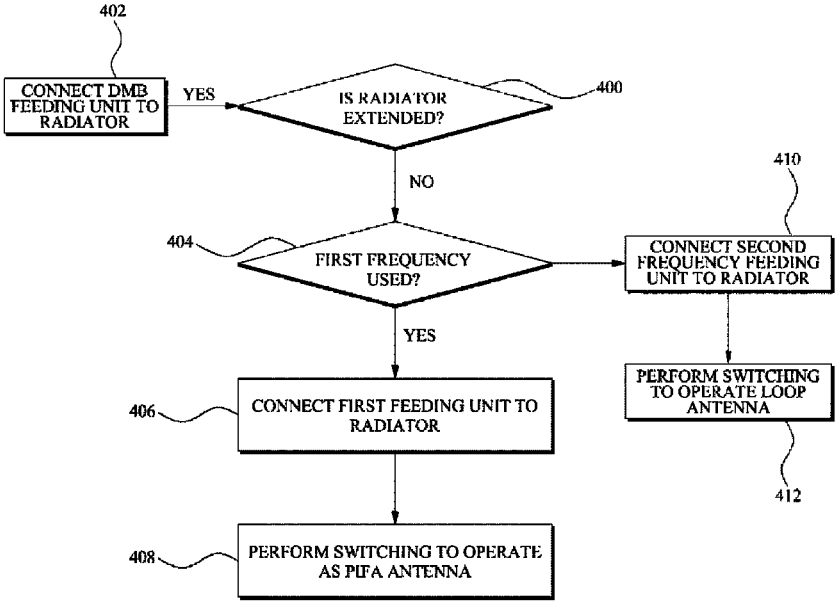
FIG. 5 is a flowchart showing an entire operation of the antenna device in accordance with the present exemplary embodiment.

FIG. 5 is a flowchart showing an entire operation of the antenna device in accordance with the present exemplary embodiment.

Referring to FIG. 5, it is determined whether the DMB radiator is extensible (step 500).

When the DMB radiator is extended, the feeding switch facilitates a connection between the DMB radiator and the DMB feeding unit to feed and receive DMB signals (step 502).

When the DMB radiator is not extended, it is determined whether the terminal is in the mode in which the first frequency band is used (step 504). When the terminal is in the mode in which the first frequency band, the feeding switch performs a switching operation to connect the first frequency feeding unit to the DMB radiator (step 506). Further, the antenna device is operated as the PIFA antenna by connecting a middle part of the DMB radiator to the ground (step 508).

When the terminal is not in the mode in which the first frequency band is used, the feeding switch performs a switching operation to connect the second frequency feeding unit to the DMB radiator (step 510). Further, the antenna device is operated as the loop antenna by connecting an end part of the DMB radiator to the ground (step 512).

The drawings and detailed description are only examples of the present invention, serve only for describing the present invention and by no means limit or restrict the spirit and scope of the present invention. Thus, any person of ordinary skill in the art shall understand that a large number of permutations and other equivalent embodiments are possible. Accordingly, it will be appreciated by any person of ordinary skill in the art that a large number of modifications, permutations and additions are possible within the principles and spirit of the invention, the scope of which shall be defined by the appended claims and their equivalents.

What is claimed is:

1. An antenna device comprising:

a radiator configured to be extensible to the outside of a terminal;

a feeding switch configured to perform a switching operation for connecting one of a plurality of feeding units to the radiator;

at least one conductive line of which a first end coming into contact with a part of the radiator when the radiator is inserted into the inside of the terminal; and at least one ground switch coupled to the at least one conductive line and configured to switch a connection between a second end of the conductive line and the ground;

wherein the feeding switch connects a back end portion of the radiator to a main feeding unit when the radiator is externally extended and connects a front end portion of the radiator to one of the first frequency feeding unit and a second frequency feeding unit when the radiator is internally inserted;

wherein a first one of the at least one conductive line is coupled to a portion between the front end portion and the back end portion of the radiator when the radiator is connected to the first feeding unit; and wherein a second one of the at least one conductive line is coupled to the back end portion of the radiator when the radiator is connected to the second feeding unit.

2. The antenna device of claim 1, wherein the feeding units includes the main feeding unit, the first frequency feeding unit, and the second frequency feeding unit.

3. The antenna device of claim 1, wherein the radiator is operated as a PIFA (Planer Inverted-F Antenna) antenna when the radiator is connected to the first feeding unit.

4. The antenna device of claim 1, wherein the radiator is operated as a loop antenna when the radiator is connected to the second feeding unit.

* * * * *